United States Patent [19]

Meece et al.

[11] 4,350,475

[45] Sep. 21, 1982

[54] INTEGRATED OIL-LESS HIGH CAPACITY AIR COMPRESSOR

[75] Inventors: Meredith W. Meece, Monroe, La.; Win W. Paget, White Lake, N.C.

[73] Assignee: International Telephone and Telegraph Corporation, New York, N.Y.

[21] Appl. No.: 132,019

[22] Filed: Mar. 20, 1980

[51] Int. Cl.[3] ..... F04B 37/00

[52] U.S. Cl. ..... 417/238; 417/368

[58] Field of Search ..... 417/238, 368, 415

[56] References Cited

U.S. PATENT DOCUMENTS

| | | | |
|---|---|---|---|
| 1,187,031 | 6/1916 | Black & Decker | 417/368 X |
| 1,964,679 | 6/1934 | Springfield | 417/238 |
| 3,039,677 | 6/1962 | Nissley | 417/415 X |
| 3,667,868 | 6/1972 | Brunner | 417/273 |
| 4,105,371 | 8/1978 | Savage et al. | 417/238 |
| 4,190,402 | 2/1980 | Meece et al. | 417/415 |

*Primary Examiner*—Richard E. Gluck

*Attorney, Agent, or Firm*—John T. O'Halloran; Peter C. Van Der Sluys

[57] ABSTRACT

An air cooled compressor is provided with a centrifugal type fan mounted on one end of a motor shaft. Cooling air is drawn through a shroud for bearing eccentric and connecting rod cooling. A shroud also directs the cooling air drawn and delivered by the fan, over the external surfaces of thinned cylinders and cylinder heads. The cooling air flowing over the thinned cylinder heads also functions to cool the intake air which assists in reducing the temperature experience within the compression chambers of the compressor. A pair of oppositely disposed openings are formed in the wall of each cylinder, which openings register with a wrist-pin that connects a connecting rod to a reciprocating piston when the piston is in the lowermost portion of a stroke within the cylinder. This construction allows the cooling air to flow through the hollow wrist-pin for cooling purposes. The cylinders are mounted to the motor frame by first securing a crankcase base to the frame, after which four equally spaced dowel pins are threaded into the crankcase base so that a pair of lugs formed on each cylinder may be slid over the dowel pins. The lugs are there to secure on dowel pins through the use of an outer bearing support which functions to hold the cylinders in place and provides an outer bearing support for the motor shaft. The outer bearing support is bolted to the dowel pins. The lugs, which are formed on cylinders are offset from the center axis of the cylinder so that a single cylinder design may be used for the opposing cylinder of the compressor. When two opposing cylinders are mounted on the dowel pins, the lugs will be axially aligned, but the cylinders will be axially offset to provide for the mounting of the connecting rods, bearings and eccentrics at offset positions on the motor shaft. When it is desired to construct a higher capacity compressor, longer dowel pins are used so that an additional one or two cylinders may be added, with each cylinder being axially offset from the others.

8 Claims, 7 Drawing Figures

INTEGRATED OIL-LESS HIGH CAPACITY AIR COMPRESSOR

BACKGROUND OF THE INVENTION

1. Field of the Invention

The present invention relates to air compressors and more particularly to an improved integrated oil-less, reciprocating high capacity compressor of the type disclosed in commonly assigned U.S. Pat. No. 4,190,402 granted Feb. 26, 1980.

2. Description of the Prior Art

Heretofore, high capacity compressors were of the reciprocating type which was necessitated in order to achieve the required pressure and air handling capacity. Compressors in the two horse power and higher range had motors connected to the compressor through a belt and pulley drive arrangements usually with a flywheel connected to the pulley shaft to assist in carrying peak loads. As a result of the belt and pulley connection, these devices were objectionably large and a real need existed for smaller size high capacity compressors.

A recent solution to the problem of size reduction was to use an integrated design where the drive unit and pump or compressor are connected in an integral unit on a single shaft. However, practical integral units have been limited to fractional horse power devices because of cooling difficulties and the extreme cyclic motor loading. Thus, the prior art high capacity compressors have all been objectionally large in size.

In the high capacity compressors, oil was used to assist in lubricating, sealing and cooling. Oiled surfaces in the cylinder helped to establish a seal between the piston and cylinder and between the valves and valve plates thereby allowing the development of higher pressures. Cooling was enhanced by the oil in two ways. Firstly, the oil would reduce the friction and thereby substantially reduce the friction generated heat. Secondly, the oil would also tend to carry away heat from the various hot spots in the compressor.

Recently a need has developed for high capacity oil-less compressors. In many compressor applications, oil cannot be tolerated, such as when compressors are used in medical devices, computers, instrumentation and certain processing devices.

Thus, a practical oil-less high capacity compressor of reduced size was not available until the development and commercialization of the compressor disclosed in the aforementioned U.S. Pat. no. 4,190,402. A compressor of this type includes a motor having a flywheel connected directly to a motor shaft which drives two opposed pistons that are simultaneously compressed so that the bearing loads are balanced. A double inlet blower is connected to said shaft and has one inlet for drawing cooling air through a crankcase for cooling the connecting rod bearings. A second inlet draws air through a vent formed in a shroud member. The blower discharges the air from both inlets into the shroud member which then directs the air to the cylinder sleeves and heads for cooling purposes. The cylinder, piston skirts and piston rings are self-lubricated by containing a fluorocarbon thereby substantially reducing the heat generating friction between said members.

While an oil-less compressor of the foregoing type has proven to be eminently successful in sizes of 2 and 3 horsepower a commercial need for higher capacity oil-less compressors has been recognized.

SUMMARY OF THE INVENTION

The present invention contemplates an oil-less high capacity, integral reciprocating compressor in 5, 7½ and 10 horsepower sizes.

Another object of the present invention is to provide an oil-less air compressor of the foregoing type having an improved method of compressor cooling and an improved method of cylinder mounting.

A further object is to provide a compressor of the foregoing type which through the use of basic componentry may be converted from 5 to 7½ to 10 horsepower by the removal, replacement and substitution of a minimum number of parts.

An important object is to provide a unique manner of cooling the piston-cylinder assemblies.

The aforenoted objects and advantages are attained by the provisions of a cooled compressor utilizing a centrifugal type fan mounted on one end of a motor shaft. Cooling air is drawn through a shroud for bearing eccentric and connecting rod cooling. A shroud also directs the cooling air drawn and delivered by the fan, over the external surfaces of the finned cylinders and cylinder heads. The cooling air flowing over the finned cylinder heads also functions to cool the intake air which assists in reducing the temperature experienced within the compression chambers of the compressor. A pair of oppositely disposed openings are formed in the wall of each cylinder, which openings register with a wrist-pin that connects a connecting rod to a reciprocating piston when the piston is in the lowermost portion of a stroke within the cylinder. This construction allows the cooling air to flow through the hollow wrist-pin for cooling purposes.

The cylinders are mounted to the motor frame by first securing a crankcase base to the frame, after which four equally spaced dowel pins are threaded into the crankcase base so that a pair of lugs formed on each cylinder may be slid over the dowel pins. The lugs are there to secure on dowel pins through the use of an outer bearing support which functions to hold the cylinders in place and provides an outer bearing support for the motor shaft. The outer bearing support is bolted to the dowel pins. The lugs, which are formed on cylinders are offset from the center axis of the cylinder so that a single cylinder design may be used for the opposing cylinder of the compressor. When two opposing cylinders are mounted on the dowel pins, the lugs will be axially aligned, but the cylinders will be axially offset to provide for the mounting of the connecting rods, bearings and eccentrics at offset positions on the motor shaft. When it is desired to construct a higher capacity compressor, longer dowel pins are used so that an additional one or two cylinders may be added, with each cylinder being axially offset from the others.

Other objects and advantages will become apparent from the following detailed description which is to be taken in conjunction with the accompanying drawings.

DETAILED DESCRIPTION OF THE PREFERRED EMBODIMENT

Figure 1:
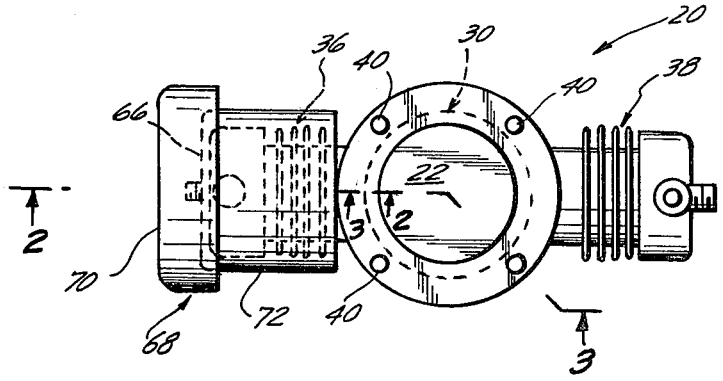
FIG. 1 is a front elevational view of a 5 horsepower air cooled oil-less compressor incorporating the teachings of this invention.
Figure 2:
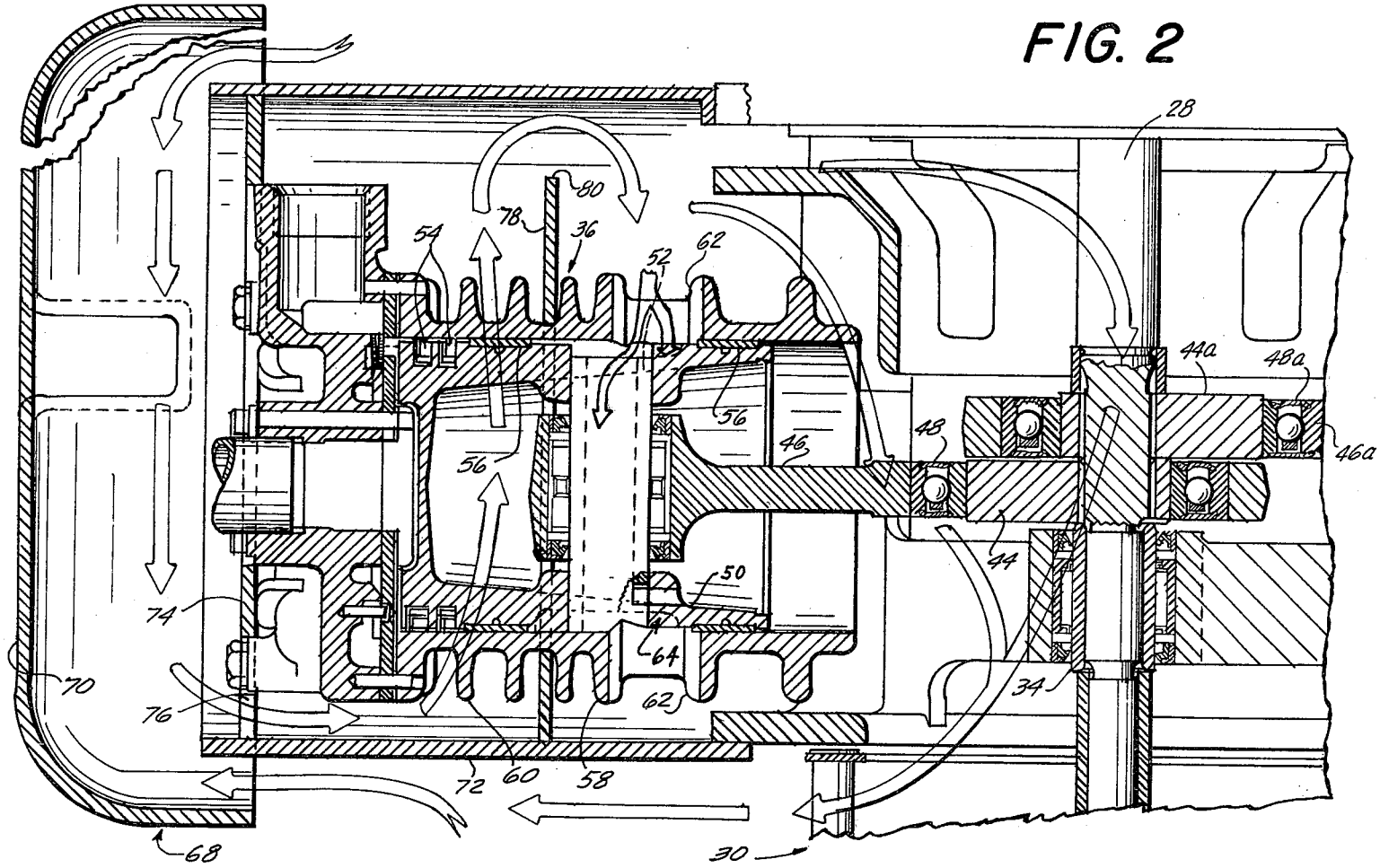
FIG. 2 is an enlarged sectional view of the piston-cylinder assemblies taken along the line 2—2 of FIG. 1, showing the path of travel of the cooling air.
Figure 3:
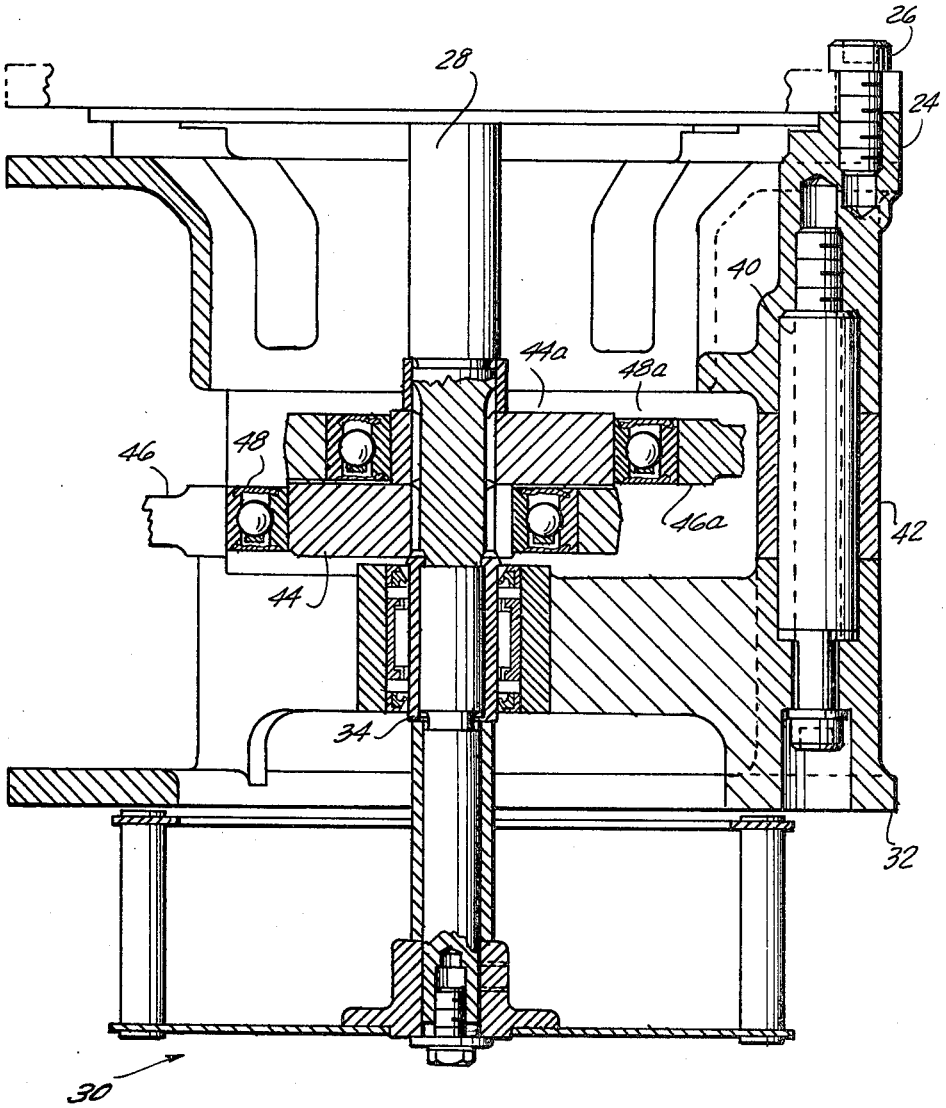
FIG. 3 is another enlarged sectional view of the motor drive shaft, the connecting rods for the pistons and the dowel pin utilized in connecting a cylinder taken along line 3—3 of FIG. 1.

Referring to FIGS. 1, 2 and 3, a 5 horsepower air compressor 20 includes a motor 22 suitably mounted on a motor frame 24 by means of a number of strategically located screws or bolts 26. A motor driven shaft 28 extends from the motor and at the other end thereof is drivably coupled with an impeller or fan assembly 30 while being drivably supported by a bearing bracket 32 through an interposed bearing 34. As will be explained in greater detail shortly, the fan assembly 30 cooperates in circulating cooling air for the compressor along a prearranged path to obtain the desired cooling effect.

In the embodiment of a 5 horsepower compressor a pair of diametrically opposed piston-cylinder assemblies 36 and 38 are provided. Towards this end, the motor mounting frame 24 and bearing bracket 32 are advantageously coupled by a dowel pin assembly 40 a predetermined length for the contemplated 5 horsepower compressor. As will be explained in detail below, the dowel pin assembly 40 is replaced for converting the compressor into a 7½ and 10 horsepower compressor.

Referring now to the piston-cylinder assembly 36 and 38, only one such assembly will be described in detail, notably, piston-cylinder assembly 36, inasmuch as both assemblies are essentially identical, with the piston-cylinder assembly 38 having the same numerals applied, but with an accompanying a. Cylinder lugs 42, two for each cylinder, are also mounted on dowel pin assembly 40. It will be noted that the axis of assemblies are not aligned since the lugs 42 are mounted to the cylinders at positions offset from the enter axes of the cylinders. In this connection, an eccentric 44 is secured for rotation with shaft 28 and is drivably coupled with the piston connecting rod 46 through the interposed bearing 48. The rod 46 is coupled with piston 50 by means of the hollow wrist-pin 52. The piston 50 is provided with a number of piston rings 54 and piston skirts 56. The cylinder 58 is provided with a number of radial circumferentially extending cooling fins 60. The cylinder 58 is provided with a pair diametrically opposed openings 62 which align with the opening in hollow wrist-pin 52 during reciprocation of the piston 50 to provide cooling of the piston. In addition, the interior of the piston 50 is cooled by circulating air passing through concentric opening 64. The intake air passes through a conventional filter assembly 66 before passing into the pump chamber in a manner well known to the art for compressor applications. Towards this end, it should be abundantly clear, that although air compressors are disclosed in detail herein vacuum pumps may also adopt the teachings of this invention.

Each of the piston-cylinder assemblies 36 and 38 are provided with a shroud that guides cooling air over the moving and reciprocating parts of the compressor incident to the operation of the fan assembly 30. In order to simplify the drwings, only one shroud 68 is illustrated in FIGS. 1 and 2 for the 5 horsepower compressor as is the case with the 10 horsepower compressor of FIG. 6. Thus, the shroud 68 for piston-cylinder assembly 36 is provided with an essentially cup-shaped vane 70 surrounding the filter 66. A cylindrically shaped member 72 is concentric with the piston-cylinder assembly 36, which includes an end plate 74 provided with aperture 76 and an inner plate 78 provided with a diametrically opposed aperture 80. Thus, in following the arrows of FIG. 2, depicting the path of travel of cooling air, a cooling effect is provided for essentially all the interior of the piston and exterior of the cylinder with most of the warm air coming from these parts being directed away from the fan assembly 30 and the exterior of the shroud 68.

Figure 4:
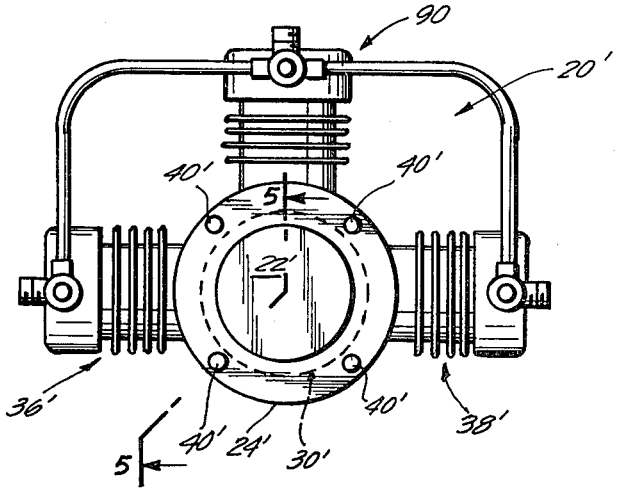
FIG. 4 is a front elevational view of a 7½ horsepower compressor incorporating the teachings of the present invention.
Figure 5:
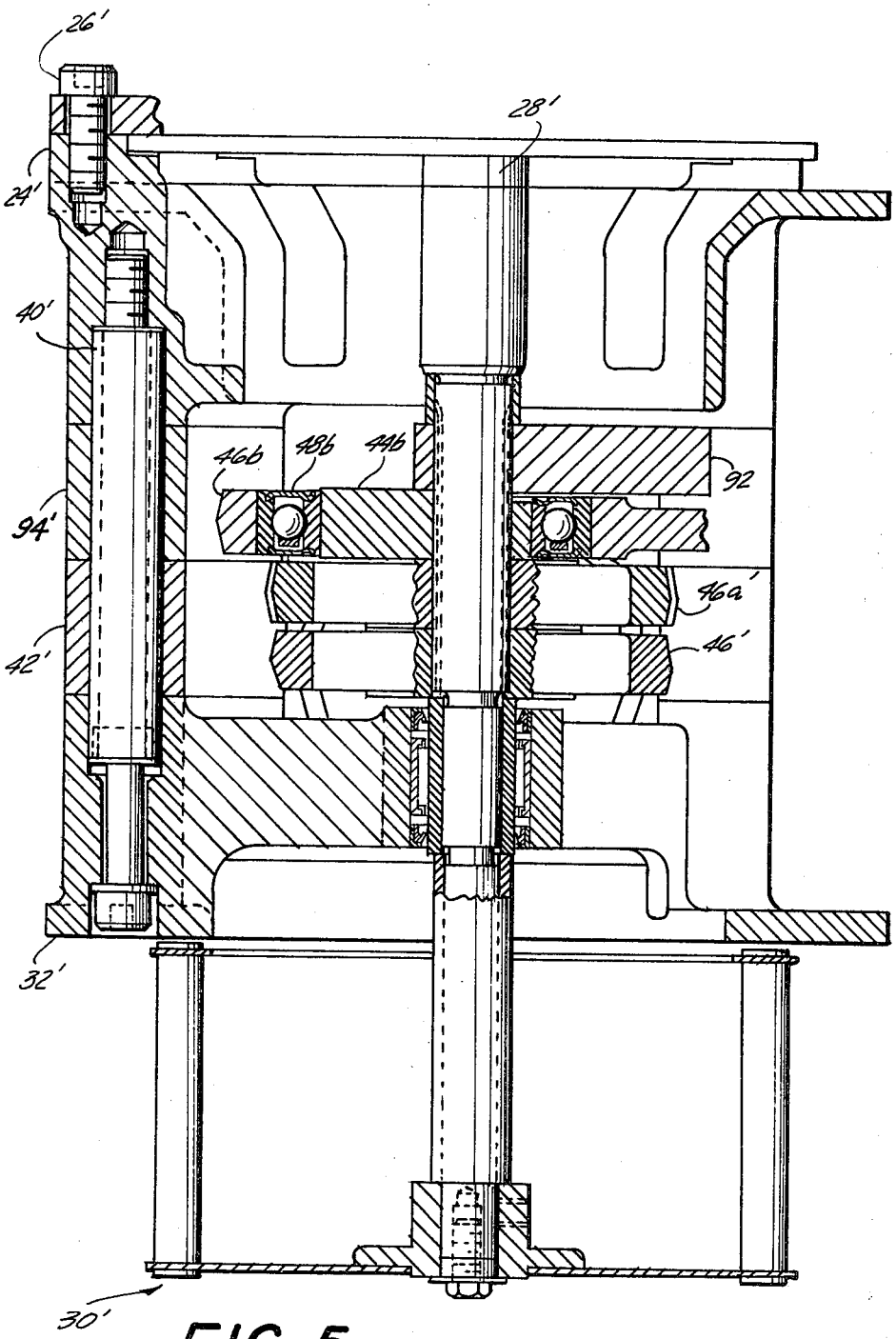
FIG. 5 is an enlarged sectional view taken along the line 5—5 of FIG. 4, showing the motor drive shaft and connecting rods for the piston-cylinder assemblies and the dowel pin utilized for connecting the cylinders.

Referring now to the 7½ horsepower embodiment of the invention shown in FIGS. 4 and 5, similar parts will be numbered with an accompanying ′ (prime). A third piston-cylinder assembly 90 will have its parts similarly numbered with an accompanying b. In order to neutralize or offset the torque generated by the third piston-cylinder assembly 90, a counter-weight 92 is rotatably mounted on the shaft 28′. A longer dowel pin assembly 40′ is utilized in this embodiment together with spacers 94′. Spacers 94′ are disposed on the dowel pins 40′ that are positioned opposite the assembly 90 so they are aligned with lugs 42*b* of the assembly 90. In all other respects the construction and operation of the 7½ horsepower compressor is similar to that of the 5 horsepower compressor including the provision of shrouds for directing the cooling air about each of the piston-cylinder assemblies.

Figure 6:
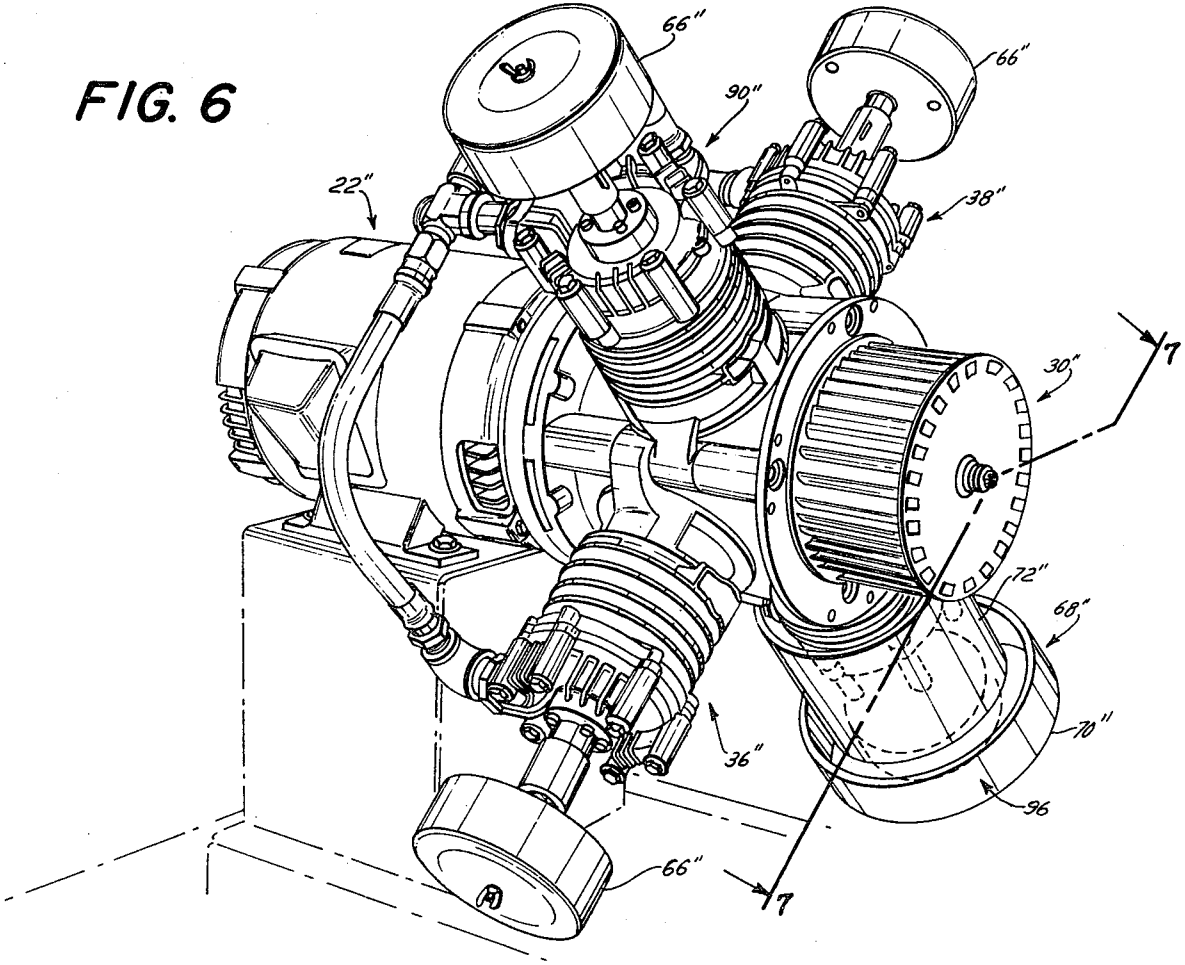
FIG. 6 is a perspective view of a 10 horsepower compressor incorporating the teachings of this invention.
Figure 7:
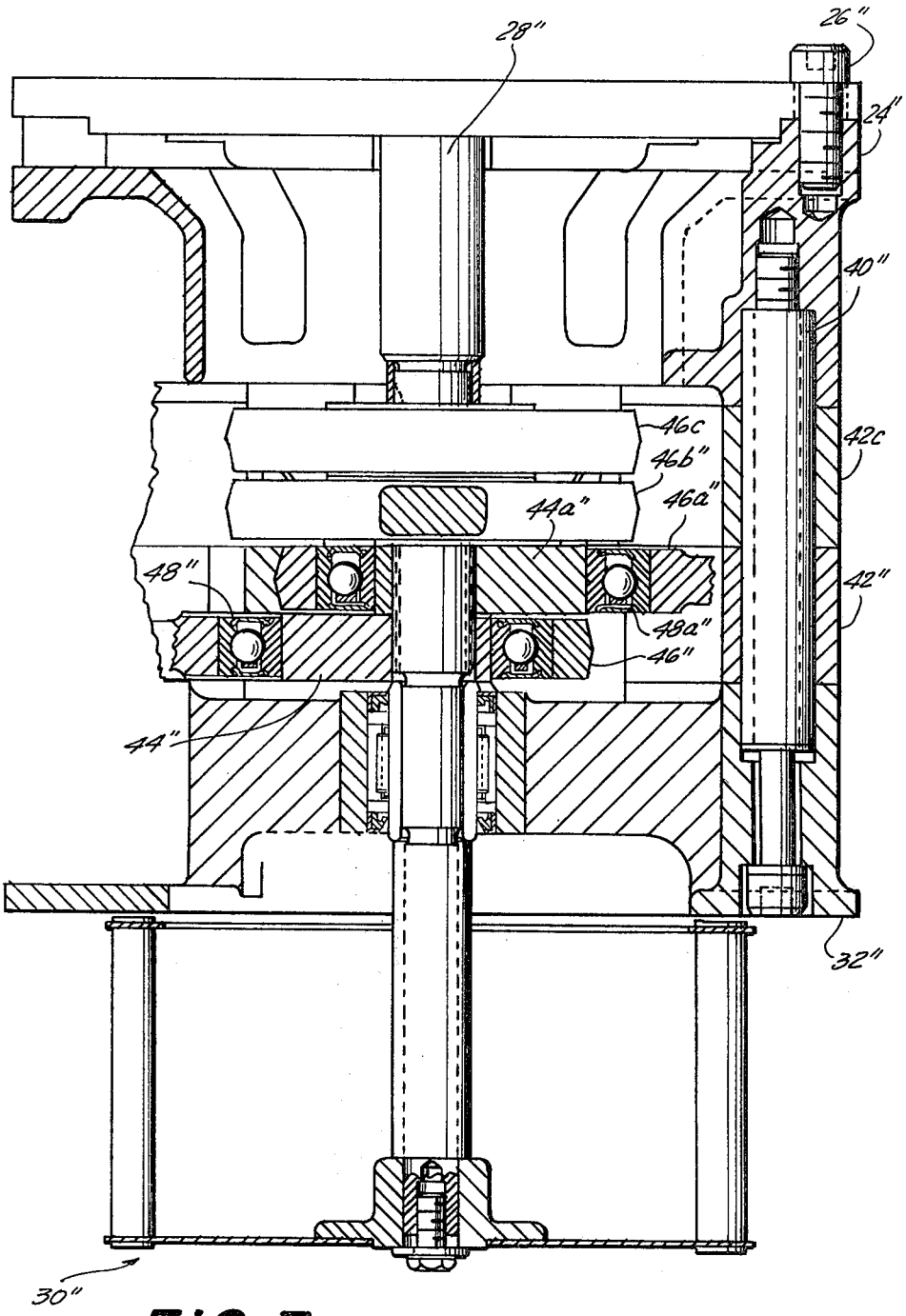
FIG. 7 is an enlarged sectional view taken along the line 7—7 of FIG. 6.

Referring now to the 10 horsepower compressor application of FIGS. 6 and 7, a fourth piston-cylinder assembly 96 is provided. In the drawings of this embodiment similar parts as in the previous embodiments will be correspondingly numbered with an accompanying ″, with the parts of the piston-cylinder assembly 96 bearing similar numbers as the parts of the other piston-cylinder assemblies, but with an accompanying c. The lugs 42*c* of assembly 96 will, in this embodiment, replace the spacers 94′ used in the 7½ horsepower compressor shown in FIG. 5. In all other respects the 10 horsepower compressor is similar to the 7½ horsepower compressor, bearing in mind that each of the piston-cylinder assemblies will be embraced by a shroud assembly for directing cooling air over the moving parts.

For details of the valving means for allowing the air or gas to controllably flow into and out of the compression chambers provided by each of the piston-cylinder assemblies, reference should be made to the above-referenced patent and other prior art compressors. Suffice it to say, that a larger capacity compressor than that contemplated in this patent is provided by the instant invention, and towards this end, compressors of 5, 7½ and 10 horsepower capacity are attained with essentially the same basic componentry. Accordingly, manufacturing, fabrication and assembly costs for providing the several sizes are most effectively minimized. In this manner, an integrated oil-less air cooled compressor of increased size having numerous applications is now available. Thus, interchangable dowel pins and spacers permit both an increase and decrease in compressor horsepower as piston-cylinder assemblies are increased or decreased in number between 2 and 4. The ability of the wrist-pins to align with holes in the cylinder facilitate the disassembly of the piston-cylinder head in changing the horsepower capacity of the compressor. Where needed the fan for the 7½ and 10 horsepower compressors may be incresed in size to increase the amount of air circulation for cooling purposes. As stated in the above, the technology and invention proposed herein is equally applicable to vacuum pumps and consequently claims herein directed to compressors are also intended to define vacuum pumps.

Although several preferred embodiments of the invention have been disclosed and described in detail herein, it should be understood that this invention is in no sense limited thereby and its scope is to be determined by that of the appended claims.

What is claimed is:

1. An integrated high capacity oil-less, air cooled compressor, comprising:

a motor having a shaft extending therefrom;

a frame extending about the shaft for mounting the motor;

a bearing bracket spaced from the frame for receiving the shaft for rotation relative thereto;

a fan coupled to the shaft for cooperating in circulating cooling air over parts of the compressor;

a pair of diametrically opposed piston-cylinder assemblies each having a cylinder and piston reciprocal therein coupled with the shaft for providing a compression chamber capable of undergoing a compression stroke incident to the reciprocation of the piston in the cylinder;

a shroud about each piston cylinder assembly for cooperating in directing the circulating cooling air over parts of the compressor;

a plurality of spaced dowel pin assemblies extending from the frame and bracket; and the cylinder of each piston-cylinder assembly having a plurality of lugs, each lug interposed between and coupled with the frame and the bracket by a dowel pin assembly.

2. The invention in accordance with claim 1, wherein each piston cylinder assembly includes a connecting rod, a hollow wrist-pin connecting the connecting rod to the piston, said hollow wrist-pin having a bore therethrough, and the cylinder having a pair of diametrically opposed openings for alignment with the bore of the wrist-pin for cooperating in cooling the piston and for facilitating the assembly and disassembly of each piston-cylinder assembly.

3. The invention in accordance with claim 1, wherein each shroud includes a cup-shaped vane spaced from and being concentric with the outer end of the cylinder, and a cylindrical member surrounding the cylinder and having an end plate having an opening therein and an inner plate disposed about the cylinder and having a diametrically opposed opening therein for directing cooling air over the cylinder and piston.

4. The invention in accordance with claim 1, wherein the compressor horsepower is increased by providing one additional piston-cylinder assembly approximately 90° relative to and interposed between the diametrically opposed assemblies, a counterweight mounted on the shaft for counterbalancing the torque of the additional piston-cylinder assembly generated during operation of the compressor.

5. The invention in accordance with claim 4, wherein the cylinder of the additional piston-cylinder assembly includes lugs interposed between the lugs of the diametrically opposed piston-cylinder assemblies and one of the said frame and bracket while being coupled with a dowel pin assembly.

6. The invention in accordance with claim 1, wherein the compressor horsepower is increased by providing another pair of diametrically opposed piston-cylinder assemblies extending along an axis substantially normal to the axis of the other pair.

7. The invention in accordance with claim 6, wherein each of the cylinders of the additional pair of piston-cylinder assemblies having a plurality of lugs, each of such lugs interposed between the lugs of the other pair of piston-cylinder assemblies and one of the said frame and bracket while being coupled with a dowel pin assembly.

8. The invention in accordance with claim 7, wherein four of said dowel pin assemblies are provided for coupling the cylinder lugs between the frame and bracket.

* * * * *